US005404793A

United States Patent [19]

Myers

[11] Patent Number: 5,404,793

[45] Date of Patent: Apr. 11, 1995

[54] CERAMIC TILE EXPANSION ENGINE HOUSING

[76] Inventor: Blake Myers, 4650 Almond Cir., Livermore, Calif. 94550

[21] Appl. No.: 70,524

[22] Filed: Jun. 3, 1993

[51] Int. Cl.[6] ..... F01B 11/02; F02F 7/00

[52] U.S. Cl. ..... 92/169.1; 415/139; 123/195 R

[58] Field of Search ..... 415/173.2, 139; 123/195 R, 193.2; 92/169.1, 169.2

[56] References Cited

U.S. PATENT DOCUMENTS

| | | | |
|---|---|---|---|
| 4,074,671 | 2/1978 | Pennila | 123/191 A |
| 4,341,826 | 7/1982 | Prewo et al. | 428/35 |
| 4,530,341 | 7/1985 | Palm | 123/669 |
| 4,562,799 | 1/1986 | Woods et al. | 123/193 C |
| 4,756,153 | 7/1988 | Roberts et al. | 415/139 X |
| 4,774,926 | 10/1988 | Adams | 123/668 |
| 4,818,176 | 4/1989 | Huether et al. | 415/9 |
| 4,841,927 | 6/1989 | Slee | 123/193.2 X |
| 4,911,109 | 3/1990 | Kawamura et al. | 123/41.74 |
| 5,035,573 | 7/1991 | Tseng et al. | 415/173.2 |
| 5,107,680 | 4/1992 | Hosnacki et al. | 92/169.1 X |
| 5,251,579 | 10/1993 | Morris | 123/195 R X |

*Primary Examiner*—Edward K. Look
*Assistant Examiner*—Hoang Nguyen
*Attorney, Agent, or Firm*—Miguel A. Valdes; Roger S. Gaither; William R. Moser

[57] ABSTRACT

An expandable ceramic tile housing for a high temperature engine is disclosed wherein each tile is independently supported in place in an interlocking matrix by retention mechanisms which mechanically couple the individual ceramic tiles to an outer metal support housing while maintaining thermal isolation of the metal housing from the ceramic tiles. The ceramic tiles are formed with either an octagonal front face portion and a square shank portion or a square front face portion with an octagonal shank portion. The length of the sides of the octagonal front face portion on one tile is equal to the length of the sides of the square front face portion of adjoining tiles to permit formation of an interlocking matrix. Fibrous ceramic sealing material may be placed between radial and tangential facing surfaces of adjacent tiles to limit radial gas flow therebetween. Labyrinth-sealed pressure-controlled compartments may be established between the tile housing and the outer metal support housing to control radial gas flow.

15 Claims, 5 Drawing Sheets

CERAMIC TILE EXPANSION ENGINE HOUSING

The invention described herein arose in the course of, or under, Contract No. W-7405-ENG48 between the United States Department of Energy and the University of California for the operation of the Lawrence Livermore National Laboratory.

BACKGROUND OF THE INVENTION

This invention relates to a ceramic tile expansion engine housing including interlocking ceramic tiles which form an expandable ceramic housing, a pressurizable external metal housing which provides a support for the ceramic tiles, and means for thermally insulating the metal housing from the ceramic housing.

There has been much interest in the use of ceramic materials in internal combustion engines which would permit such engines to operate at much higher temperatures. It has, for example, been proposed to line combustion surfaces with high temperature ceramics. Typical suggestions of this nature may be found, for example, in Pennila U.S. Pat. No. 4,074,671 and Adams U.S. Pat. No. 4,774,926, which suggest the use of ceramic coatings on combustion chamber surfaces, as well as in Prewo et al. U.S. Pat. No. 4,341,826, Palm U.S. Pat. No. 4,530,341, Woods et al. U.S. Pat. No. 4,562,799, and Kawamura et al. U.S. Pat. No. 4,911,109 which suggest the use of ceramic inserts or liners, including monolithic liners, for use in such engines.

It has also been proposed to use ceramic materials in the development of a class of fuel-tolerant ceramic expansion engines such as Roots-type engines and Lysholm-type engines which utilize the expansion of hot gases to turn fluted rotors. Such engines, like internal combustion engines, operate best at elevated temperatures above the normal operating temperatures tolerated by either conventional metal parts or less conventional high temperature metal alloys.

While, as discussed above, it has been proposed to provide surfaces capable of withstanding higher temperatures by lining metal surface with ceramics, or by the use of ceramic monoliths such as cylinder liners, such approaches fail to take into account the degree of expansion which such ceramic parts will undergo as they heat up from room temperature up to the operating temperature, as well as the tremendous thermal mismatch which will occur when the ceramic parts are used as lining materials in combination with metal parts, with no provision for expansion or contraction.

SUMMARY OF THE INVENTION

It is, therefore, an object of this invention to provide an engine housing constructed of ceramic tiles which will be capable of withstanding high operating temperatures and which will permit thermal expansion as the engine temperature rises during use.

It is another object of the invention to provide a ceramic tile engine housing which further includes a pressurizable external metal housing which provides a support for the ceramic tile engine housing.

It is yet another object of the invention to provide a ceramic tile engine housing which further includes an external metal support housing to support the ceramic tile engine housing and means for thermally isolating the external metal support housing from the ceramic tile engine housing.

These and other objects will be apparent from the following description and accompanying drawings.

DETAILED DESCRIPTION OF THE INVENTION

The invention comprises an expandable ceramic tile housing for a high temperature engine wherein each tile is independently supported in an interlocking matrix. The ceramic tiles are supported in place by retention means which mechanically couple the ceramic tiles to an outer metal support housing while maintaining thermal isolation of the metal housing from the ceramic tiles.

Figure 1:
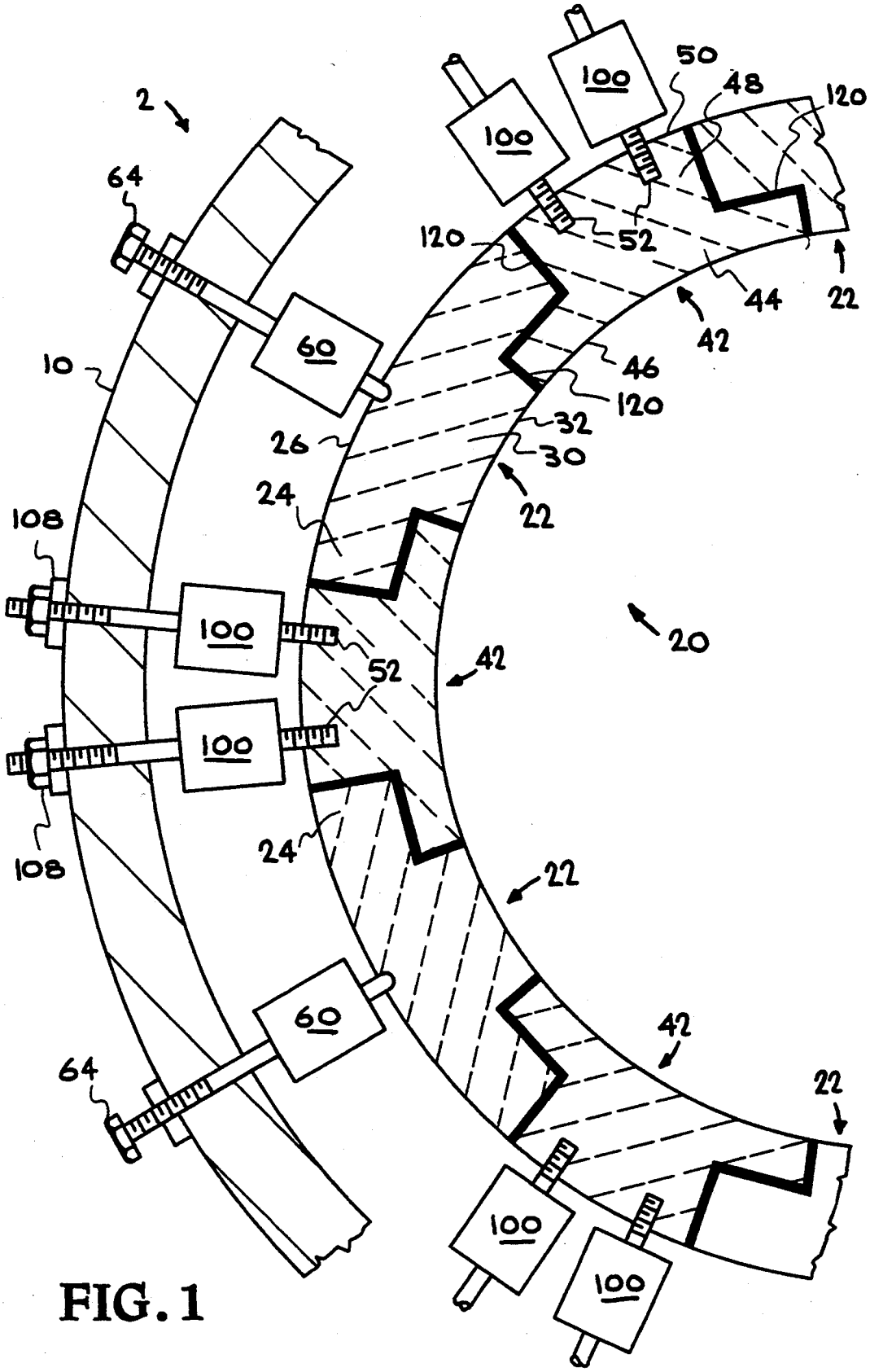
FIG. 1 is a fragmentary cross-sectional view of one embodiment of the expandable ceramic tile engine housing of the invention showing the ceramic tile matrix used to form the ceramic engine housing.

Turning now to FIG. 1, a fragmentary portion of a typical expandable ceramic tile engine housing constructed in accordance with the invention is generally illustrated at 2 comprising an outer metal support housing 10 which preferably comprises a sealed housing which will permit housing 10 to be pressurized, either at a single pressure, or as will be described below, at various pressures by segmenting the interior of housing 10.

Within outer metal housing 10 is inner expandable ceramic engine housing 20 which comprises an interlocking matrix of ceramic tiles designated as push tiles 22 and pull tiles 42. Such ceramic tiles may comprise any ceramic material capable of withstanding the desired operating temperature of the engine, as well as capable of being molded, machined, or otherwise formed into the desired shape as will be described below. Examples of such ceramic materials, by way of illustration and not of limitation, include silicon nitride, silicon carbide, boron nitride, boron carbide, and aluminum oxide.

Figure 2:
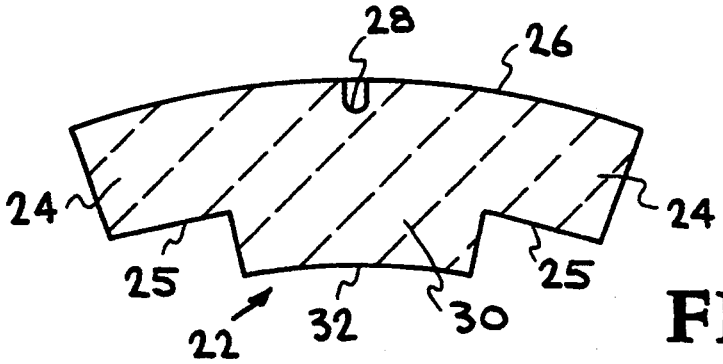
FIG. 2 is a cross-sectional view of one type of ceramic tile, designated as a push tile, used in the ceramic tile matrix which forms the ceramic engine housing.
Figure 4:
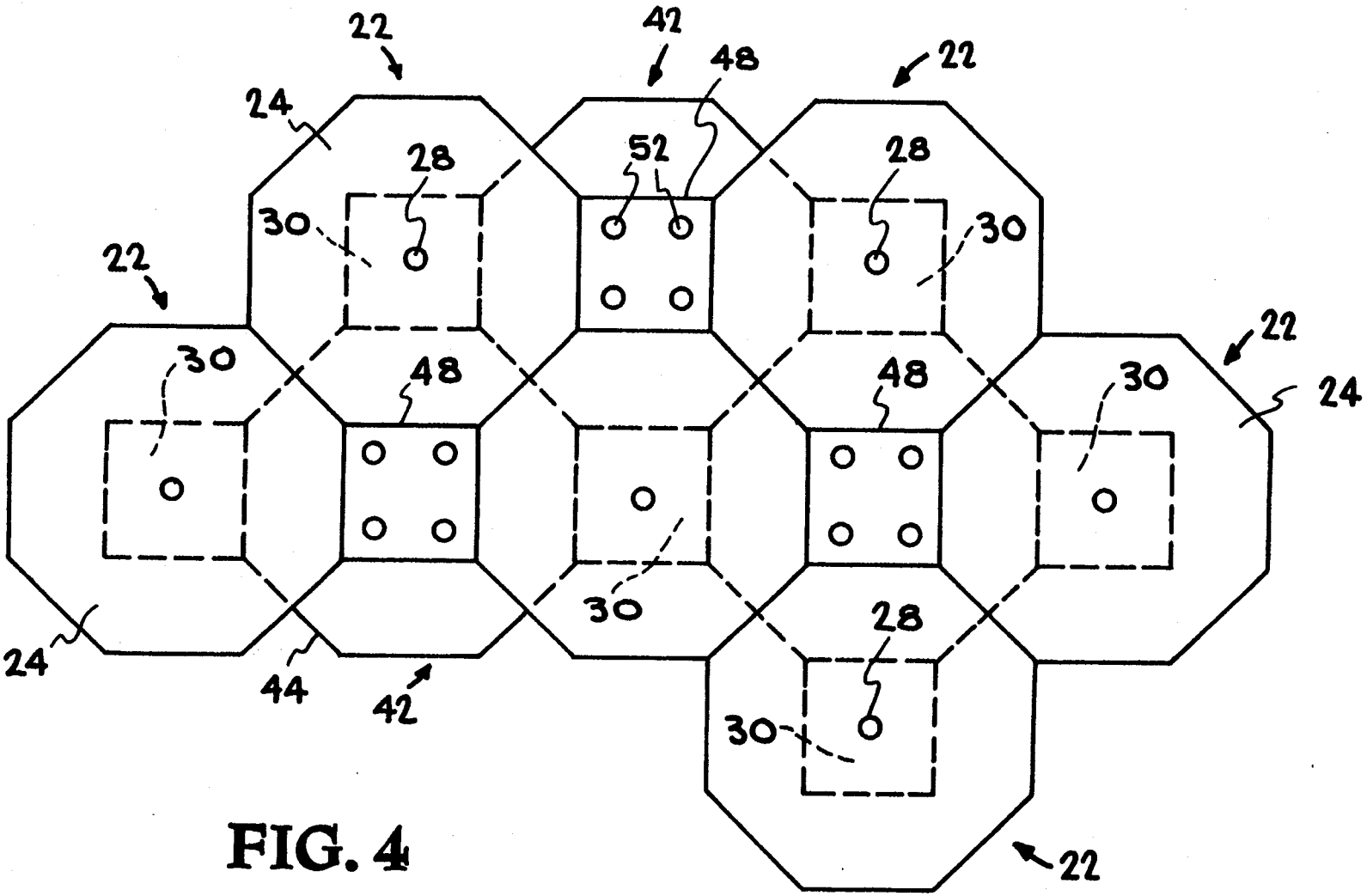
FIG. 4 is a top view illustrating the interlocking configuration of the push tiles and pull tiles forming the matrix comprising the expandable ceramic tile engine housing.

Push tiles 22 are so designated because they are supported from metal housing 10 by a pushing action as will be described below. As shown in FIGS. 1, 2, and 4, push tiles 22 are formed with an octagonal shaped upper portion 24 having a top or outer surface 26 with a spherical detente centrally located 28 therein, and a lower square shaped shank portion 30, having a lower or inner surface 32 thereon which is curved to conform with the desired shape of the inner surface of ceramic engine housing 20. Each side face of octagonal sided portion 24 is the same length as each side face on square shaped shank portion 30 to permit formation of an interlocking matrix of push files 22 and pull tiles 42 as will be described below. For the same reason the thickness of octagonal sided portion 24 is preferably the same thickness as shank portion 30 of push tile 22.

Figure 3:
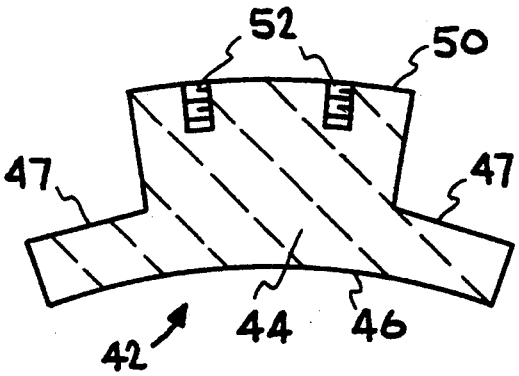
FIG. 3 is a cross-sectional view of the other type of ceramic tile, designated as a pull tile, used in the ceramic tile matrix which forms the expandable engine housing.

As shown in FIGS. 1, 3, and 4, pull tiles 42 are provided with an octagonal inner portion 44 having a lower or inner curved surface 46 which, like curved inner surface 32 of push tile 22, is curved to conform with the desired shape of the inner surface of ceramic engine housing 20. Curved surface 46 of pull tile 42 and curved surface 32 of push tile 22 provide a continuous curved surface, as best seen in FIG. 1, when interlocked together in the continuous pattern shown in FIG. 4.

Pull tile 42 is further provided with an upper square shaped shank portion 48 having an upper surface 50 thereon containing three or four threaded bores 52, as shown in FIGS. 3 and 4, which are used to urge pull tile 42 toward outer metal support housing 10, as will be described below. As previously discussed with respect to push tiles 22, each side face of octagonal sided portion 44 is the same length as each side face on square shaped shank portion 48 to permit formation of the interlocking matrix of push tiles 22 and pull tiles 42 shown in FIG. 4.

As shown in FIG. 1, and best seen in FIG. 4, the square-sided shank portions 30 of push tiles 22 cooperate with the octagonal-sided portions 44 of pull tiles 42 to form an interlocking matrix, as shown by the dotted lines in FIG. 4. The respective bottom surfaces 32 and 46 of the interlocking push tiles and pull tiles form the continuously curved inner engine surface seen in FIG. 1. At the same time, the outer square-sided shank portions 48 of pull tiles 42 cooperate with the octagonal-sided upper portions 24 of push tiles 22 to form the same type of interlocking matrix between tiles 22 and 42 on the outer surface of the expandable ceramic tile engine housing 20, as shown in the solid lines in FIG. 4.

Therefore, as also mentioned earlier with respect to push tiles 22, the thickness of octagonal sided portion 44 is preferably the same thickness as shank portion 48 of pull tile 42. In addition, the thickness of octagonal sided portion 44 of pull tile 42 must be the same as the thickness of shank portion 30 of push tile 22 so that when push tiles 22 and pull tiles 42 are assembled together in the matrix shown in FIG. 4, the curved undersurface of the tiles (surfaces 32 and 46) will form the continuous curved surface shown in FIG. 1.

If the thickness of octagonal sided portion. 44 is the same thickness as shank portion 48 of pull tile 42; the thickness of octagonal sided portion 24 is the same thickness as shank portion 30 of pull tile 22; and the thickness of octagonal sided portion 44 of pull tile 42 is also the same as shank portion 30 of push tile 22; then the thickness of octagonal sided portion 24 of push tile 22 will also be the same as the thickness of shank portion 48 of pull tile 42. That is, the thickness of all of the shank and octagonal portions of both types of tiles will be the same.

Alternatively, the octagonal and shank portions of a particular type of tile (either push tile or pull tile) may differ from one another as long as the thickness of octagonal sided portion 44 of pull tile 42 is the same as the thickness of shank portion 30 of push tile 22 so that the curved inner surface formed by the interlocking matrix of push files and pull tiles is continuous.

Push tiles 22 and pull tiles 42 are respectively supported by outer metal housing 10 via push mechanism 60 and pull mechanism 100. Push mechanism 60 comprises a first bolt 62 having a bolt head 64 and which is received in a threaded bore 12 in metal housing 10. Rounded bolt end 66 of bolt 62 is received in a spherical detente 74 formed in the top surface 72 of horizontal portion 71 of a cylindrical or U-shaped yoke member 70 having a depending skirt portion 76. When bolt 62 is turned in threaded bore 12 (clockwise for right handed threads or counter-clockwise for left handed threads), end 66 of bolt 62 will urge yoke member 70 toward push tile 22.

Figure 6:
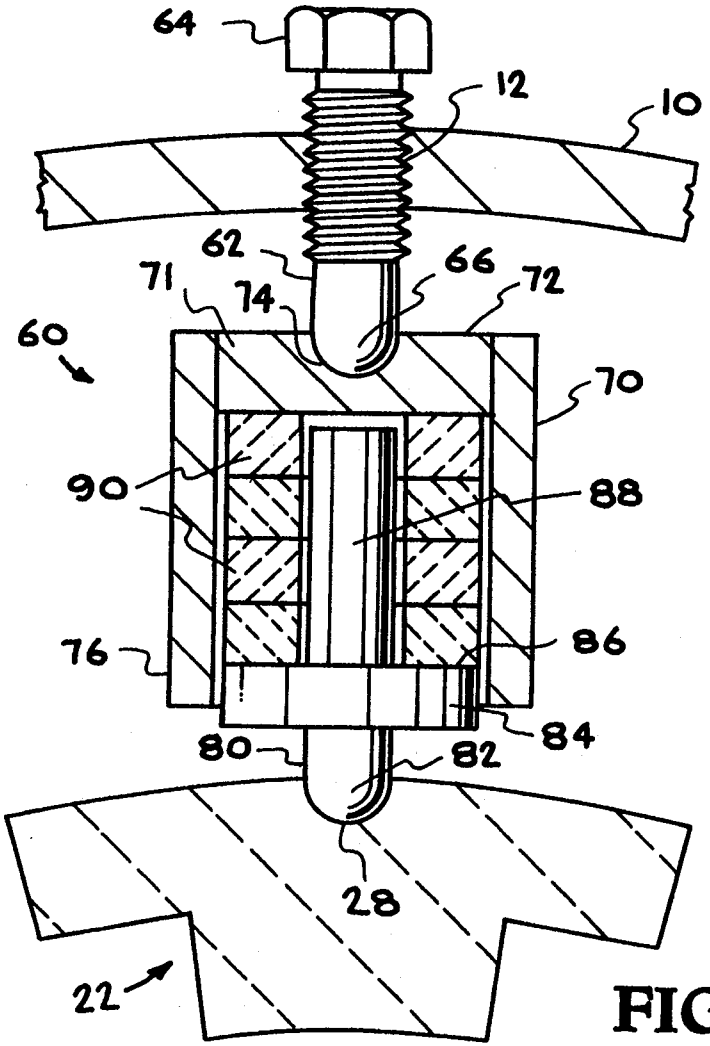
FIG. 6 is a vertical cross-sectional view of the mechanism used to retain a push tile in the ceramic tile matrix in place with respect to the outer metal housing.

A metal shaft 80 is provided between push tile 22 and yoke member 70 having a rounded lower end 82 (which is received in spherical detente 28 of push tile 22), a shoulder 84 having a top surface 86, and an upper shaft portion 88. Stacked on upper surface 86 of shoulder 84 of shaft 80 are a group of ceramic washers 90, four of which are shown in FIGS. 1 and 6. Ceramic washers 90 provide mechanical coupling between ceramic shaft 80 in contact with push tile 22 and bolt 62 in contact with metal housing 10, while at the same time thermally isolating bolt 62 from shaft 80. This, in turn, thermally isolates outer metal housing 10 from ceramic push tile 22. Ceramic thermal isolation washers 90 may be formed of any one of a number of ceramic materials such as, by way of illustration and not of limitation, silicon nitride, silicon carbide, boron nitride, boron carbide, and aluminum oxide. Since the most important thermal resistance is through the interfaces between the washer, rather than through the bulk, it is preferable to use a plurality of washers, rather than a single thick washer. A stack of four such ceramic washers, with an overall height, as shown in FIG. 6, approximately equal to the outside diameter of the ceramic washers, has been found to provide good results.

Thus, when bolt 62 is turned to approach push tile 22, rounded end 66 bears on yoke member 70 and undersurface 78 of horizontal portion 71 of yoke 70 then bears down on ceramic washers 90. This pushes down on ceramic shaft 80, via shoulder 84 and top surface 86 thereof, which is in contact with the stack of ceramic washers 90. Shaft 80 then bears down or "pushes" on push tile 22. Therefore, when turning bolt 62 so that push tile 22 is pushed down, i.e., away from outer metal housing 10, undersurface 25 of upper octagonal portion 24 of push tile 22 will be urged against the upper surface 47 of lower octagonal portion 44 of pull tile 42 to provide a sealing effect therebetween.

Figure 7:
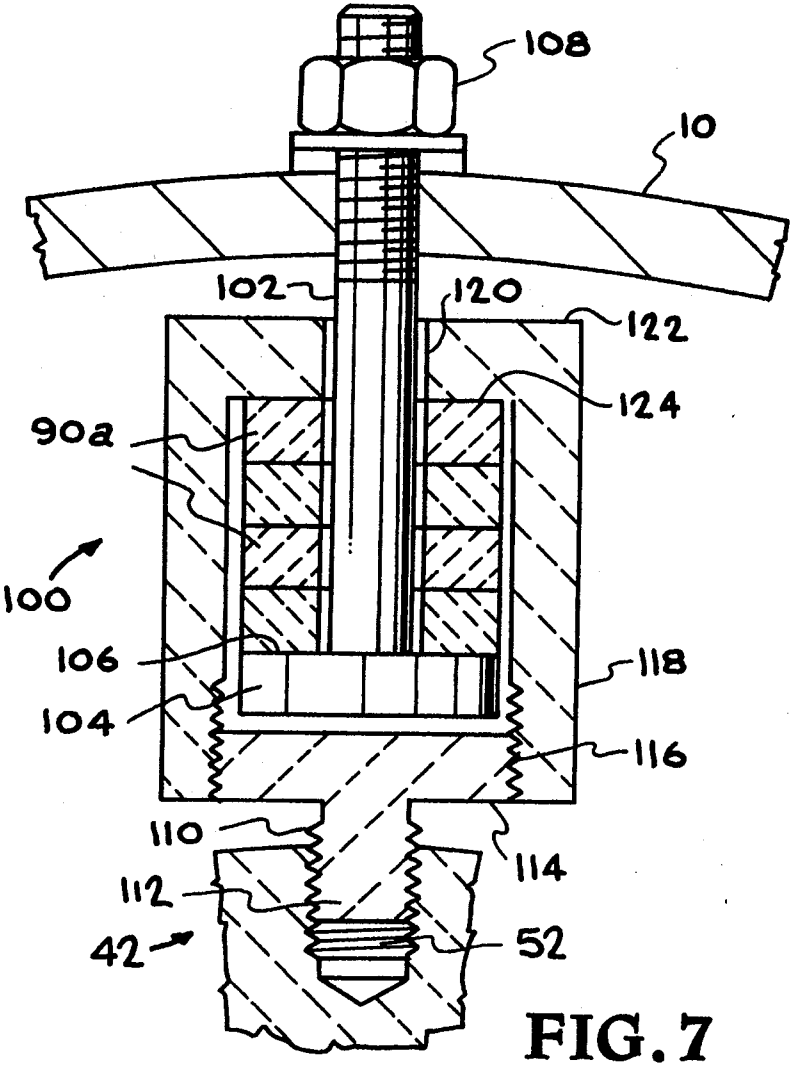
FIG. 7 is a vertical cross-sectional view of the mechanism used to retain a pull tile in the ceramic tile matrix in place with respect to the outer metal housing.

Turning now to FIG. 7, pull mechanism 100 is shown which pulls or urges pull tile 42 toward outer metal shell 10 and which will, in cooperation with push mechanism 60, urge or pull upper surface 47 of octagonal portion 44 of pull tile 42 against lower surface 25 of octagonal portion 24 of push tile 22 to provide a seal therebetween.

Pull mechanism 100 comprises a threaded shaft 102 having an enlarged head portion 104 on one end thereof with a shoulder 106 on head portion 104 on which are placed another set of ceramic washers 90*a* similar to the ceramic washers 90 used with push mechanism 60, to provide thermal isolation between ceramic pull tile 42 and outer metal support housing 10. Threaded shaft 102 is provided with a nut 108 at its opposite end which rests on support housing 10 and which, when turned, will raise or lower threaded shaft 102 with respect to housing 10.

A second threaded shaft 110, which is constructed of ceramic material, is received, at one end, in threaded bore 52 in pull tile 42 and is provided, at its opposite end, with a threaded head or enlarged portion 114. The threaded head 114 of shaft 110 is received in a threaded bore 116 in a ceramic cylindrical member 118 having a central opening 120 in an opposite end 122 thereof. Shaft 102 is mounted in central opening 120 of cylinder 118 with its head 104 therein and the opposite (threaded) end protruding therefrom. Alternatively, end portion 122 of cylindrical member 118 may be a separate portion threadedly received in a bore (not shown) in cylindrical member 118, similar to the manner in which threaded head 114 is received in threaded bore 116 at the opposite end of cylindrical member 118. Ceramic washers **90*a*, mounted on shoulder 106 of head 104 on shaft 102, bear against the lower surface 124 of end 122 of cylinder 118**.

Tightening nut 108 on shaft 102 to cause shaft 102 to move upwardly toward housing 10 then causes head 104 on shaft 102 to also move toward housing 10 carrying ceramic washers **90*a* toward housing 10 with head 104. Ceramic washers 90*a* then contact undersurface 124 of end 122 of cylinder 118 causing cylinder 118 to also move toward housing 10. This, in turn, causes shaft 110 to move toward housing 10 carrying pull tile 42** with it.

Figure 5:
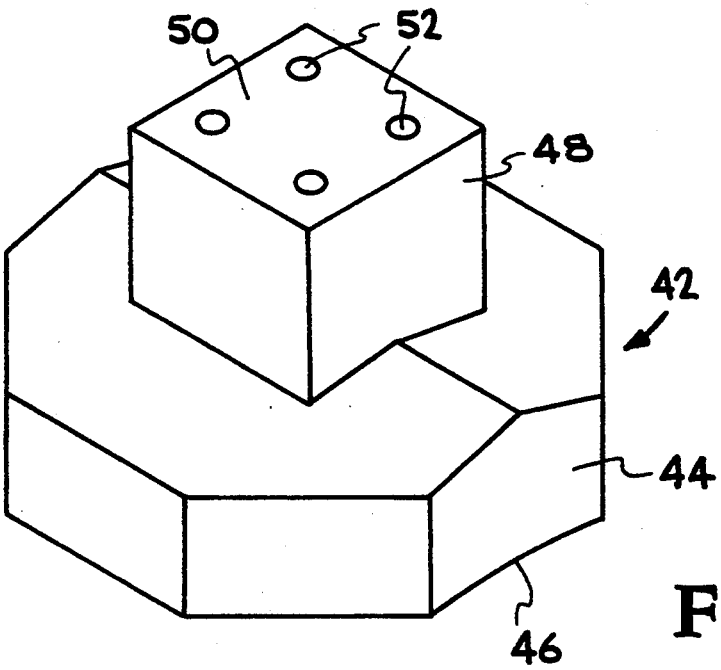
FIG. 5 is an isometric view of a ceramic pull tile such as shown in FIGS. 1, 3, and 4.

This outward movement or "pulling" of pull tile 42 toward housing 10 forces upper surface 47 on octagonal portion 44 of pull tile 42 against lower surface 25 on octagonal portion 24 of push tile 22. To provide for adjustable movement of pull tile 42 toward engagement with push tile 22 in the manner just described, at least three such pull mechanisms 100 are threaded into threaded bores 52 in the upper surface 50 of pull tile 42. Preferably four such pull mechanisms are threaded into bores 52 arranged in a square in top surface 50 of the square upper shank portion 48 of pull tile 42, as shown in FIGS. 4 and 5.

While the actions of push mechanisms 60 and pull mechanisms 100 force the facing surfaces of the respective adjacent push tiles and pull files into engagement with one another in an interlocking manner, it is preferable that a gasket material be placed between such surfaces which is capable of withstanding the elevated temperatures to which the ceramic housing 20 will be exposed. A fibrous ceramic felt material 120, such as FIBERFRAX®, a fibrous ceramic felt available from The Carborundum Company, or ZIRCAR®, a fibrous ceramic felt available from Zircar Products, Inc., can be placed between the tangential and radial facing surfaces of pull tiles 42 and push tiles 22 so that the actions of push mechanisms 60 and pull mechanisms 100 will result in a compression or crushing of fibrous felt material 120 to provide minimum gas flow between the adjacent tiles, as best seen in FIG. 1.

As described above, push tiles 22 are formed with a lower curved surface 32, and pull tiles 42 are formed with a lower curved surface 46. Both such surfaces are formed by molding or other appropriate shaping to generally conform to the desired inner shape of the engine surface, e.g., cylinder surface. When the engine is assembled, the respective push and pull tiles may be further adjusted or fine tuned to provide the desired curvature after which surfaces 32 and 46 may be further ground down in situ to provide the exact desired curvature and close tolerance between the engine wall and the moving part, e.g., cylinder, rotor, etc. which will be fitted into engine housing 20. Alternatively, surfaces 32 and 46 may be ground immediately after assembly of the tile matrix and then fine adjustment of the individual files may be carded out after such a grinding step. Combinations of such steps such as adjustment, grinding, and then readjustment may also be carded out in any order desired to obtain the best possible fit between the expandable ceramic tile engine housing and the moving parts therein.

In this respect, it should also be pointed out that the form of construction and adjustment of the expandable ceramic tile engine housing of the invention also permits a final adjustment of the individual ceramic tiles to be made after the engine has reached operating temperature, i.e., after all expected thermal expansion has occurred, thus permitting a tight, yet not binding, tolerance between the ceramic wall and the moving parts of the engine even when the engine is operating at temperatures as high as 1300° C.

While the foregoing description has illustrated, in FIGS. 1, 6, and 7, the use of a stack of four ceramic washers or spacers to provide thermal isolation between the inner ceramic tile engine housing and the outer metal support housing, the use of more or less ceramic washers is within the contemplation of the invention, depending upon the degree of thermal isolation desired, the thickness of each such ceramic washer, and the thermal transmission of the particular material selected for use in forming such washers.

It may also be possible to provide a spring washer sandwiched between such ceramic washers to thereby provide not only the desired thermal isolation, but also to provide a yieldable spring bias which may assist: in maintaining the desired clearances between the inner ceramic engine housing wall and the moving parts within the engine. Naturally, of course, the use of such a spring material within yoke 70 or cylinder 118 would necessitate selection of a material such as, for example, tantalum or molybdenum, capable of withstanding the temperatures at the hot end of the stack, or superalloys for the cold end of the stack.

As referred to earlier, the space between outer metal support housing 10 and the respective push and pull tiles may be pressurized at a pressure greater than ambient, but slightly less than that encountered within the engine to thereby further enhance or reinforce the seal formed between the adjoining ceramic files of the engine. Furthermore pressure gradients may be established within this space, depending upon the need for same, depending upon the type of engine to which the expandable ceramic tile engine housing will be used with.

Figure 8:
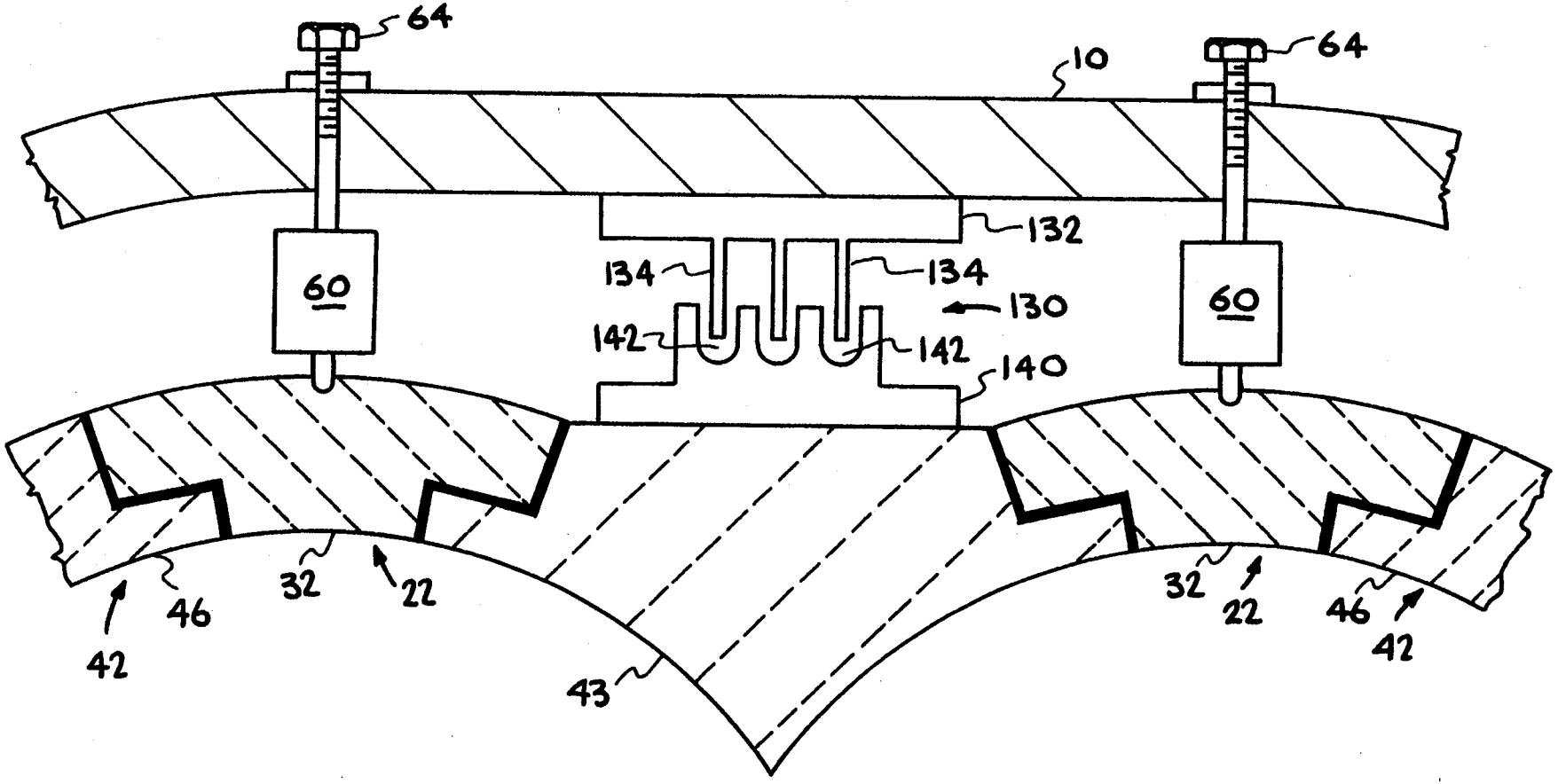
FIG. 8 is a vertical cross-sectional view of another embodiment of the invention wherein a partition is used in the space between the outer metal support housing and the inner ceramic tile engine housing to permit formation of pressure gradients to divide such space into two compartments when a modification of the ceramic engine housing is used for a dual rotor engine.

For example, referring to the embodiment shown in FIG. 8, a partition structure could be utilized, such as generally shown at 130, which may be mounted in the space between outer metal support housing 10 and the outer or upper surfaces 26 and 50 of the respective push and pull tiles. A mounting block 132 secured to the inner wall of outer metal support housing 10 may be provided with a series of continuous or circumferential fins 134 which interleave with depressions 142 formed in one or more mounting block 140 secured to the outer surfaces of one or more of the ceramic blocks to thereby divide the space between outer metal housing 10 and ceramic blocks 22 and 42 into a series of pressure partitions or cells divided by labyrinths, established as shown schematically in FIG. 8, which are pressurized to a level just above the peak working pressure at that region in the engine. Partition structure 130 is particularly useful in the embodiment of FIG. 8, as will be described below.

In the embodiment of FIG. 8, the expandable ceramic tile engine housing of the invention is shown in use on a dual rotor engine such as a helically fluted intermeshing rotor Lysholm engine. In such an embodiment, push tiles 22 and pull files 42 mesh with v-shaped inner surfaces of a key tile 43 located at the intersection of the respective cylinders in which the intermeshing rotors are mounted. The remainder of the push tiles 22 and pull tiles 42 fit together in a manner identical to that previously described for the single cylinder embodiment previously described. The same push mechanisms 60 and pull mechanisms 100 may be used with a modified outer metal support housing (not shown) appropriately modified to conform to the modified inner ceramic housing configuration.

Thus, the invention provides an expandable and adjustable ceramic tile engine housing useful in any type of engine operated at elevated temperatures with close tolerances between the inner engine walls formed by the ceramic tiles and the moving parts of the engine. The ceramic tiles are mechanically supported by an external metal housing while thermal isolation is maintained between the ceramic tiles and the metal support housing. Adjustment of the position of individual ceramic tiles may be made externally from the outer surface of the metal housing even while the engine is running at operating temperature. A pressure may be maintained in the space between the outer metal housing and the ceramic tiles, and pressure gradients may be maintained within such space.

While specific embodiments of the expandable ceramic tile engine housing have been illustrated and described in accordance with this invention, modifications and changes of the apparatus, parameters, materials, etc. will become apparent to those skilled in the art, and it is intended to cover in the appended claims all such modifications and changes which come within the scope of the invention.

What is claimed is:

1. An expandable engine housing containing interlocking ceramic tiles and comprising:

a) an outer metal support housing;

b) a matrix of said ceramic tiles within said metal support housing and spaced therefrom, each having a first surface shaped to provide the desired inner surface of the engine housing, and having side surfaces shaped to provide an interlocking matrix of said tiles; and c) adjustment and support means coupled to each of said tiles and to said outer metal housing whereby each of said ceramic tiles may be individually adjusted relative to said metal support housing and relative to adjoining ceramic tiles.

2. The expandable engine housing of claim 1 wherein said outer metal support housing comprises a sealed housing to permit pressure to be maintained between said outer metal support housing and said interlocking matrix of ceramic tiles.

3. The expandable engine housing of claim 1 wherein said ceramic tiles comprise alternate octagonal and square shaped portions wherein the length of each side of said octagonal shaped portion is equal to the length of each side of said square shaped portion to thereby provide said interlocking matrix.

4. The expandable engine housing of claim 3 wherein said interlocking matrix of ceramic tiles alternately comprise:

a) pull tiles having an octagonal shaped portion with a curved front face formed thereon and a square shaped shank portion; and b) push tiles having a square shaped portion with a curved front face thereon and an octagonally shaped shank portion;

whereby said curved front face on said octagonal shaped portion on said pull tiles and said curved front face on said square shaped portion of said push tiles form a continuous curved surface.

5. The expandable engine housing of claim 4 wherein said adjustment and support means coupled to each of said ceramic tiles respectively push said push tiles away from said metal support housing and pull said pull tiles toward said metal support housing.

6. An expandable engine housing containing interlocking ceramic tiles and comprising:

a) an outer metal support housing;

b) a matrix of said interlocking ceramic tiles within said metal support housing and spaced therefrom, said ceramic tiles comprising:

i) a plurality of a first type tile comprising an octagonal shaped front portion with a curved front surface thereon and a square shaped shank portion on the opposite side of said octagonal shaped portion from said curved front face thereon;

ii) a plurality of a second type tile comprising a square shaped front portion with a curved front surface thereon and an octagonal shaped shank portion on the opposite side of said square shaped portion from said curved front face thereon, the length of each side of said square shaped front portion of said second type tile being equal to the length of each side of said octagonal shaped front portion of said first type tile to thereby permit said first and second type tiles to form an interlocking matrix therebetween; and c) adjustment and support means mounted between said tiles and said outer metal support housing comprising:

i) means for individually moving each of said tiles with respect to said outer metal support housing; and ii) means for thermally isolating said tiles from said outer metal support housing;

whereby each of said ceramic tiles may be individually adjusted relative to said metal support housing and relative to adjoining ceramic tiles.

7. The expandable engine housing of claim 6 wherein said outer metal support housing comprises a sealed housing to permit the space between said outer metal support housing and said interlocking matrix of ceramic tiles to be pressurized.

8. The expandable engine housing of claim 7 wherein said space between said outer metal support housing and said interlocking matrix of ceramic tiles is divided into two or more compartments to permit a plurality of pressures to be maintained in said space.

9. The expandable engine housing of claim 6 wherein said means for thermally isolating said tiles from said outer metal support housing comprise ceramic means interposed between said outer metal support housing and said ceramic tiles.

10. The expandable engine housing of claim 9 wherein said ceramic means interposed between said outer metal support housing and said ceramic tiles to thermally isolate said tiles from said metal housing further comprise a plurality of ceramic washers carried by said means for individually moving each of said tiles with respect to said outer metal support housing.

11. The expandable engine housing of claim 6 wherein the thickness of said octagonal front portion of said first type tile is equal to the thickness of said square shaped front portion of said second type tile, whereby said curved front surfaces of said respective tiles will be continuous when said first and second type tiles are formed into said interlocking matrix.

12. The expandable engine housing of claim 11 wherein said adjustment and support means mounted between said first type tile and said outer metal support housing comprises:

a) a first ceramic bolt member having a threaded shank end received in a threaded bore in the top surface of said squared shaped shank portion of said ceramic tile and an enlarged head portion having external threads thereon;

b) a second metal bolt member having a head portion at one end, a threaded shank portion on the opposite end, and a nut on said threaded shank portion to engage the outer surface of said metal support housing when said threaded shank portion of said second bolt is passed through an opening in said outer metal support housing;

c) a ceramic cylinder member having an open end with internal threads therein to receive said externally threaded head portion of said first bolt member, and an opposite closed end having a central opening therein large enough to permit said shank end of said second bolt member to pass therethrough; and d) a plurality of ceramic washers mounted on said second bolt member between said head of said second bolt member and the inner surface of said closed end of said cylinder member to thermally isolate said second bolt member in thermal communication with said outer metal support housing from said cylinder in thermal communication with said ceramic tile;

whereby when said nut on said second bolt member is turned to urge said head on said second bolt member toward said outer metal support housing, said head on said second bolt member will urge said ceramic washers against said cylinder end to move said cylinder toward said outer metal support housing and said cylinder member will move said first bolt member and said first type tile toward said outer metal support housing.

13. The expandable engine housing of claim 11 wherein said adjustment and support means mounted between said second type tile and said outer metal support housing comprises:

a) a threaded bolt member received in a threaded bore in said outer metal support housing and having an enlarged head portion on a first end thereof, to engage the outer surface of said outer metal support housing, and a rounded opposite end thereon;

b) a metal yoke member comprising a horizontal member having a central detente therein to receive said rounded end of said bolt member and a skirt portion peripherally depending from said horizontal portion of said yoke member;

c) a ceramic shaft member having a first end extending into the underside of said yoke member, a second rounded end received in a central detente in the face of the octagonal portion of said second type ceramic tile, and an enlarged shoulder portion on said shaft at a point adjacent the end of said skirt on said yoke member; and d) a plurality of ceramic washers mounted on said shaft member between the under surface of said horizontal portion of said yoke member and a surface of said shoulder portion on said shaft facing said horizontal portion of said yoke member to thermally isolate said shaft member in thermal communication with said ceramic tile from said yoke member in thermal communication with outer metal support housing through said threaded bolt;

whereby when said head on said bolt member is turned to urge said rounded opposite end of said bolt member toward said yoke member and away from said outer metal support housing, said yoke member will urge said ceramic washers against said shoulder portion on said shaft member and said shaft member will push on said second type of ceramic tile to push surfaces on said second type of tile into engagement with facing surfaces on said first type of tile.

14. The expandable engine housing of claim 11 wherein fibrous ceramic sealing means are interposed between facing tangential and radial surfaces on said first and second type ceramic tiles whereby when said surfaces are respectively pulled or pushed into engagement with one another, said fibrous ceramic sealing means will provide for reduced gas flow between adjacent tiles in said interlocking tile matrix.

15. An expandable engine housing containing interlocking ceramic tiles and comprising:

a) a sealed outer metal support housing;

b) a matrix of said interlocking ceramic tiles within said metal support housing and spaced therefrom, said ceramic tiles comprising:

i) a plurality of a first type tile comprising an octagonal shaped front portion with a curved front surface thereon and a square shaped shank portion on the opposite side of said octagonal shaped portion from said curved front face thereon;

ii) a plurality of a second type tile comprising a square shaped front portion with a curved front surface thereon and an octagonal shaped shank portion on the opposite side of said square shaped portion from said curved front face thereon, the length of each side of said square shaped front portion of said second type tile being equal to the length of each side of said octagonal shaped front portion of said first type tile to thereby permit said first and second type tiles to form an interlocking matrix therebetween, said thickness of said square shaped front portion of said second type tile being equal to the thickness of said octagonal shaped front portion of said first type tile whereby said curved front surfaces of said respective tiles will be continuous when said first and second type tiles are formed into said interlocking matrix;

c) fibrous ceramic means interposed between tangential and radial facing surfaces of said first and second type of ceramic tile to reduce gas flow between adjacent tiles;

d) first adjustment and support means mounted between said first type tiles and said outer metal support housing comprising:

i) a first ceramic bolt member having a threaded shank end received in a threaded bore in the top surface of said squared shaped shank portion of said ceramic tile and an enlarged head portion having external threads thereon;

ii) a second bolt member having a head portion at one end, a threaded shank portion on the opposite end, and a nut on said threaded shank portion to engage the outer surface of said metal support housing when said threaded shank portion of said second bolt is passed through an opening in said outer metal support housing;

iii) a ceramic cylinder member having an open end with internal threads therein to receive said externally threaded head portion of said first bolt member, and an opposite closed end having a central opening therein large enough to permit said shank end of said second bolt member to pass therethrough; and iv) a plurality of ceramic washers mounted on said second bolt member between said head of said second bolt member and the inner surface of said closed end of said cylinder member to thermally isolate said second bolt member in thermal communication with said outer metal support housing from said cylinder in thermal communication with said ceramic tile;

whereby when said nut on said second bolt member is turned to urge said head on said second bolt member toward said outer metal support housing, said head on said second bolt member will urge said ceramic washers against said cylinder end to move said cylinder toward said outer metal support housing and said cylinder member will move said first bolt member and said first type tile toward said outer metal support housing; and e) second adjustment and support means mounted between said second type tiles and said outer metal support housing comprising:

i) a threaded bolt member received in a threaded bore in said outer metal support housing and having an enlarged head portion on a first end thereof, to engage the outer surface of said outer metal support housing, and a rounded opposite end thereon;

ii) a yoke member comprising a horizontal member having a central detente therein to receive said rounded end of said bolt member and a skirt portion peripherally depending from said horizontal portion of said yoke member;

iii) a ceramic shaft member having a first end extending into the underside of said yoke member, a second rounded end received in a central detente in the face of the octagonal portion of said second type ceramic tile, and an enlarged shoulder portion on said shaft at a point adjacent the end of said skirt on said yoke member; and iv) a plurality of ceramic washers mounted on said shaft member between the under surface of said horizontal portion of said yoke member and a surface of said shoulder portion on said shaft facing said horizontal portion of said yoke member to thermally isolate said shaft member in thermal communication with said ceramic tile from said yoke member in thermal communication with outer metal support housing through said threaded bolt;

whereby when said head on said bolt member is turned to urge said rounded opposite end of said bolt member toward said yoke member and away from said outer metal support housing, said yoke member will urge said ceramic washers against said shoulder portion on said shaft member and said shaft member will push on said second type of ceramic tile to push surfaces on said second type of tile into sealing engagement with facing surfaces on said first type of tile;

whereby each of said ceramic tiles may be individually adjusted relative to said metal support housing and relative to adjoining ceramic tiles.

* * * * *